US005399477A

United States Patent [19]

Maskasky

[11] Patent Number: 5,399,477

[45] Date of Patent: Mar. 21, 1995

[54] SILVER HALIDE PHOTOGRAPHIC ELEMENTS

[75] Inventor: Joe E. Maskasky, Rochester, N.Y.

[73] Assignee: Eastman Kodak Company, Rochester, N.Y.

[21] Appl. No.: 201,598

[22] Filed: Feb. 25, 1994

[51] Int. Cl.[6] ..... G03C 1/035

[52] U.S. Cl. ..... 430/567; 430/569

[58] Field of Search ..... 430/567, 569

[56] References Cited

U.S. PATENT DOCUMENTS

| | | | |
|---|---|---|---|
| 4,386,156 | 5/1983 | Mignot | 430/567 |
| 4,435,501 | 3/1984 | Maskasky | 430/434 |
| 4,643,966 | 2/1987 | Maskasky | 430/567 |
| 4,895,794 | 1/1990 | Ogawa | 430/567 |
| 4,968,595 | 11/1990 | Yamada et al. | 430/567 |
| 4,977,074 | 12/1990 | Saitou et al. | 430/567 |
| 5,264,337 | 11/1993 | Maskasky | 430/567 |
| 5,275,930 | 1/1994 | Maskasky | 430/567 |
| 5,292,632 | 3/1994 | Maskasky | 430/567 |

FOREIGN PATENT DOCUMENTS

| | | | |
|---|---|---|---|
| 0302528 | 2/1989 | European Pat. Off. | G03C 1/02 |
| 0460656 | 12/1991 | European Pat. Off. | G03C 1/035 |
| 0534395 | 3/1993 | European Pat. Off. | G03C 1/005 |
| 63-239437 | 10/1988 | Japan . | |
| 569971 | 11/1993 | Japan . | |

OTHER PUBLICATIONS

Abstract of JP 4-155327 (Oct. 1990).
Abstract of JP 4-335632 (Nov. 1992).
Abstract of JP 4-283742 (Mar. 1991).
Abstract of JP 3-212639 (Jan. 1990).
Abstract of JP 1-155332 (Dec. 1987).
Abstract of JP 3-41845 (Aug. 1986).

*Primary Examiner*—Janet C. Baxter
*Attorney, Agent, or Firm*—Peter C. Cody

[57] ABSTRACT

Disclosed are photographic elements comprising a silver halide emulsion having incorporated therein silver halide grains, wherein the grains are essentially tabular in morphology and have at least two parallel {100} major faces and substantially equivalent {111} corner faces or substantially equivalent {110} corner faces or substantially equivalent {110} side faces.

8 Claims, 2 Drawing Sheets

SILVER HALIDE PHOTOGRAPHIC ELEMENTS

FIELD OF THE INVENTION

This invention relates to photography. More specifically, it relates to photographic elements comprising silver halide grains having a novel morphology.

BACKGROUND OF THE INVENTION

Virtually all silver halide grains utilized in photography exhibit face centered cubic ("rock salt") crystal lattice structures. Face centered cubic lattice structures are those lattice structures that have an internal ion arrangement—a crystal lattice—akin to the arrangement of ions in standard table salt (NaCl). Each lattice structure, barring imperfections or impurities which could distort the ionic arrangement, has similar ion types (anion or cation) occupying the corners and center of each face of a cube.

Although presently utilized silver halide grains have cubic lattices, such lattices, as noted, define an internal structure. The external appearance of grains defined by cubic lattices may be cubic, but they may also take any one of a number of other morphologies.

Known morphologies for cubic lattice type silver halide grains are as described in, for example, Maskasky, "The Seven Different Kinds of Crystal Forms of Photographic Silver Halides" Journal of Imaging Science, Vol. 30, 1986, pp. 247–255. Known forms include the cube, octahedron, rhombic dodecahedron trisoctahedron, icositetrahedron, tetrahexahedron, and hexoctahedron.

In addition to describing silver halide grains according to their morphology, it is common practice in the art to describe grains by reference to their crystalline faces. Typically, Miller indices are utilized to define each face which bounds a silver halide grain. Miller indices, calculations thereof, and their manner of application are described in *Crystals Perfect and Imperfect* by A. Bennet, D. Hamilton, A. Maradudin, R. Miller and J. Murphy: Walker and Company, New York, 1965.

For cubic grains, the six crystal faces are usually referred to as {100} crystal faces, such reference being based upon the appropriate Miller indices. While the {100} crystal face designation is most commonly employed in connection with cubic silver halide grains, these same crystal faces are sometimes referred to as {200} crystal faces, the difference in designation resulting from a difference in the definition of the basic unit of the crystal structure.

Octahedral grains have eight identical crystal faces that are referred to as {111} crystal faces. Rhombic dodecahedral grains have twelve identical faces that are referred to as {110} crystal faces. The remaining morphologies of silver halide grains all have distinctive crystalline face arrangements. Each face can be defined by reference to the appropriate Miller indices which, in turn, can be confirmed by a combination of visual inspection and the determination of the angle formed by the intersection of adjacent crystalline faces. This method of confirming the Miller indices of a certain crystal face may also be utilized to confirm that a given face is a {100}, {111} or {110} crystal face.

Although {100} crystal faces represent the faces of a cubic grain, {111} crystal faces represent the faces of an octahedral grain, and {110} crystal faces represent the faces of a rhombic dodecahedral grain, such faces may also be found in more irregularly shaped grains. An example of grains having a different morphology and yet also having {100} crystalline faces are the {100} silver bromide tabular grains of U.S. Pat. No. 4,386,156 or the silver chloride tabular grains of U.S. Pat. Nos. 5,264,337, 5,275,930, and 5,292,632, and published European Patent Application 0 534 395. The grains of these references are tabular rather than cubic, and their primary faces have {100} Miller indices.

U.S. Pat. No. 5,275,930 similarly discloses {100} tabular grains. Specifically, it relates to chemically sensitized high chloride tabular grain emulsions comprising tabular grains having {100} major crystal faces. Epitaxies, which are deposits of silver halide on a host grain wherein the deposit is of a different halide composition then the host, and wherein there is minimal or no gradient of halide from the host to the deposit, are grown at one or more of the corners of the tabular grains.

Other examples of tabular grains having epitaxial growths on their surfaces are disclosed in U.S. Pat. No. 4,435,501.

European Patent Application 0 569 971, though not directed at tabular grains having epitaxial growths, discloses rectangular parallelogram shaped tabular grains having a {100} plane as the main plane, and having from one to four corners non-equivalently eliminated. Although the resulting corner faces may be of the {111} type, they are formed from eliminated corners rather than by protruding silver halide. Thus, the grains' major surfaces maintain an essentially planar form. Further, the projections of these grains are either rectangular parallelograms having one corner eliminated, or rectangular parallelograms having multiple corners eliminated but wherein the eliminated corners are non-equivalent; that is, the area of the maximum eliminated portion divided by the area of the minimum eliminated portion is two or more.

Not all tabular grains need to be bounded by {100} major faces. U.S. Pat. No. 4,968,595, for instance, discloses tabular grains having no epitaxial junctions, and having {111} major faces which initiate development at the corners or edges of the grains.

European Patent Application 0 460 656, discloses tabular silver halide grains that have {111} major faces. Dislocations reside within the major surface regions of such grains. Similarly, U.S. Pat. No. 4,643,966 discloses a silver halide emulsion containing host tabular grains having {111} major faces. However, the major faces of these grains are subsequently ruffled by the precipitation or ripening of additional silver halide onto the major faces. Ruffles are protrusions emanating from the tabular surface of the host grains. The protrusions may be small three sided "pyrimids", each side of the pyramid having other than a {111} crystal face.

European Patent Application 0 302 528 does not disclose tabular grains as described above but does disclose silver halide grains comprising both a {111} plane and a {100} plane and capable of forming a latent image on the {100} plane. The {111} plane occupies at least 40% of the surface of the grains or the {100} plane occupies at least 60% of the surface of the grains.

U.S. Pat. No. 4,977,074 discloses substantially circular tabular grains having both a twin plane and a basal plane. The basal planes are of the {111} type and the grains have a {100} plane at their rounded edge portions.

Although the art is replete with examples of tabular grains, of tabular grains having distortions on their surfaces, and of tabular grains having epitaxial deposits on their surfaces, the art has yet to provide tabular {100} grains having multiple corner or side faces wherein the corner or side faces are equivalent and are selected to be of a different type than the major faces of the {100} tabular grains. It has further been unrecognized in the art how to grow protruding {111} or {110} corner or side faces on {100} tabular grains wherein the growth of the non-{100} corner or side faces on {100} tabular grains is accomplished in the absence of epitaxial deposition.

SUMMARY OF THE INVENTION

It is thus an object of the present invention to provide photographic elements comprising silver halide grains of a unique and advantageous morphology.

It is a further object of the invention to provide photographic elements comprising silver halide grains that enable the separation of spectral and chemical sensitization sites.

These and other objects of the invention, which will be apparent from the description that follows, are accomplished by a photographic element comprising a support and a silver halide emulsion layer, the silver halide emulsion layer having incorporated therein silver halide grains, wherein the grains are essentially tabular in morphology and have at least two parallel {100} major faces and substantially equivalent {111} corner faces or substantially equivalent {110} corner faces or substantially equivalent {110} side faces.

The corner or side faces of the grains employed in the present invention allow for the separation of spectral and chemical sensitization sites. This separation of sites minimizes the probability of latent image destruction resulting from the oxidation of latent image silver centers by dye holes. It provides that elements containing such grains can exhibit improved photographic speed over prior art photographic elements.

DETAILED DESCRIPTION OF THE INVENTION

Figure 1:
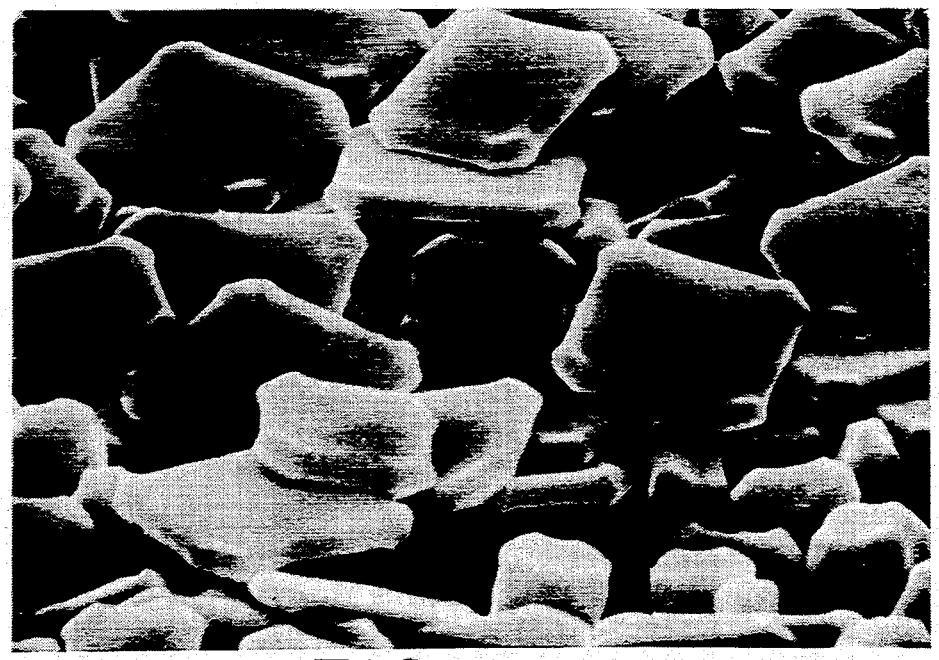
FIG. 1 is a scanning electron micrograph (×10,000) of the grains employed in a preferred embodiment of the invention, Example 1.

The present invention relates to photographic silver halide elements comprising novel silver halide grains having an essentially tabular morphology with two {100} major faces and multiple {111} or {110} corner or multiple {110} side faces. When multiple corner faces exist, such faces are of the same crystalline face type; that is, they are either all {111} faces or all {110} faces. Further, when present, the corner faces are substantially equivalent.

By substantially equivalent, it is meant that the area of each corner face is substantially equivalent to the area of any and all other corner faces. The area of any one corner face is preferably no more than about 50%, more preferably no more than about 30%, and optimally no more than about 10%, larger than the area of any other corner face.

When the corner faces are {111} corner faces and generation (i.e. formation) of such faces is extensive, that is the area of each face is quite large, pairs of the eight {111} corner faces will overlap, thus providing that the projections of the grains have eliminated corners. Because the corner faces are substantially equivalent, it necessarily follows that their generation be done in an equivalent manner. It further follows that any elimination of the corners in the projected grains due to overlapping of the corner faces will also be substantially equivalent. Thus, when viewed from above, the grains employed in the present invention that have extensively generated {111} corner faces will appear to have substantially equivalently eliminated corners. Substantially equivalently eliminated corners means that the area of the maximum eliminated portion (of the projected image of the grain) divided by the area of the minimum eliminated portion (of the projected image of the grain) is less than 2, preferably less than about 1.5, and optimally less than about 1.25.

When the corner faces are {110} corner faces, they will be perpendicular to the plane of the major faces and they will run from one major face to the next. Thus, the {110} corner faces will automatically provide that the projected image of the grain have eliminated corners. As with grains having {111} corner faces, grains having {110} corner faces will have substantially equivalently eliminated corners.

When grains employed in accordance with the present invention have {110} side faces, the faces, like the {111} or {110} corners faces, are substantially equivalent. However, because the present invention utilizes rectangular parallelogram shaped seed tabular grains (as described in greater detail below), the {110} side faces must be substantially equivalent relative to their opposing or parallel faces. If the seed grain has major faces that are square, then the {110} side faces may be substantially equivalent relative to all other {110} side faces. Further, whether the seed grain has major faces that are square or are some other rectangular parallelogram, extensive generation of the side faces will provide a grain whose projection is a rectangular parallelogram. Such grains can be recognized, however, because they have {110} side faces that make an angle of 135° with the adjacent {100} major fade (By contrast, {100} side faces make an angle of 90° with the adjacent {100} major faces.).

By "essentially tabular", it is meant that the grain is initially tabular having an aspect ratio greater than about two, but that during preparation of the novel grains of the invention, the tabularity of the grain may be distorted as described below.

In a preferred embodiment, silver halide is precipitated or ripened on seed tabular grains having two parallel {100} major faces in such a manner that the precipitated silver halide is deposited primarily on the edges (e.g. corners and/or sides) of the seed grain. Deposition can occur until the edge precipitate is quite substantial. Essentially, the only limitation in the amount of such precipitation is that the edge precipitate may not close in upon itself, thus encapsulating multiple voids.

Because deposition most likely does not occur in a uniform manner but rather occurs as a gradient along the seed grain's surface, the initial seed tabular grain generally will not maintain its original shape. Instead, it may become concave on each of its major parallel faces as less silver halide is deposited in the center of each surface than is deposited on the edge of each surface. Such distortion of the original seed grain may further be affected by silver halide in the seed grain being ripened onto the edges during precipitation. Though this latter distortion is less likely to occur, it may nevertheless be present.

The tabular grains utilized in the formation of the present invention's preferred grains can be any of the numerous {100} tabular grains known in the art. Examples of tabular grains having {100} major faces are described in U.S. Pat. Nos. 4,386,156 and 5,264,337, both of which are incorporated herein by reference.

Aspect ratios of such tabular grains can be as low as two but may also be as high as 15 or even higher. Preferably, the tabular grains have an aspect ratio of greater than about two; more preferably, greater than about five; and optimally, greater than about eight. Aspect ratio is a term known in the art and can be defined as the ratio of the equivalent circular diameter to thickness, the equivalent circular diameter being the diameter of a circle having an area equal to the projected area of the grain.

Because the surfaces of the preferred grains of the invention have protrusions emanating therefrom, it is difficult to precisely measure the thickness of the grains and hence their aspect ratios. Therefore, when defining the grains employed in the present invention, thickness measurements are intended to represent the average thickness of the grains, including both the grains' central regions and their edges.

The grains employed in the present invention comprise at least two parallel {100} major faces that are square or rectangular in shape (or square or rectangular in shape with the corners eliminated) and multiple {111} or {100) corner faces or multiple {110} side faces. Preferably, the grains comprise eight {111} corner faces, or four {110} corner faces and eight {110} side faces. The {111} corner faces may be even with the plane of the parallel major faces; they may protrude only slightly; or they may protrude significantly so that the appearance of each grain approximates an octahedron. The {110} corner and side faces may similarly be even with the plane of the parallel major faces; they may protrude only slightly; or they may protrude significantly so that the appearance of each grain approximates a rhombic dodecahedron.

In a more preferred embodiment, the grains comprise a base portion of silver halide having two parallel {100} major faces and additional deposits of silver halide that protrude from the {100} major faces and form, at their surfaces, the {111} or {110} faces.

In the novel grains utilized in the present invention, cubic lattice forming silver halides of any composition may be used. Moreover, the initial tabular grains may be of a distinctly different composition than that of the edge precipitate. It is preferred, however, that the edge precipitate be of the same type of halide composition as the base portion. In such a scenario, the edge precipitate is, by definition, not an epitaxial growth.

Preferably the grains employed in the present invention are predominantly silver chloride or silver bromide. By predominantly silver chloride or silver bromide, it is meant that such grains are greater than 50 molar percent of the indicated silver halide. Preferably, the indicated silver halide accounts for greater than about 75 molar percent, and more preferably greater than about 85 molar percent. The grains may also contain iodide up to about 40 mole percent, although it is preferred that iodide content be less than about 25 mole percent. Iodide levels can vary in accordance with the amount of iodide soluble in a face centered cubic crystal lattice. For purely silver iodochloride grains, iodide content generally will not exceed about 13 mole percent; for purely silver iodobromide grains, iodide content generally will not exceed about 38 mole percent.

The grains employed in the present invention are incorporated into a photographic element comprising a support and a silver halide emulsion layer. Preferably, the grains are incorporated in the emulsion layer so that they represent at least ten percent of the total projected area of silver halide. More preferably the grains are incorporated in the emulsion layer so that they represent at least 50 percent of the total projected area of silver halide. Emulsions comprising the described grains as the sole silver halide grains are also contemplated.

The present invention may be practiced in black-and-white, reversal, color negative or paper photographic elements utilizing any other type of silver halide grains. These other grains may be conventional in form such as cubic, octahedral, or cubooctahedral, or they may be irregular such as spherical grains or tabular grains. The other grains may be present in the emulsion containing the invention's novel grains or they may be present in adjacent or other emulsion layers within photographic element.

The photographic elements of the present invention may be simple single layer elements or multilayer, multicolor elements. Multicolor elements contain dye image-forming units sensitive to each of the three primary regions of the visible light spectrum. Each unit can be comprised of a single emulsion layer or of multiple emulsion layers sensitive to a given region of the spectrum. The layers of the element, including the layers of the image-forming units, can be arranged in various orders as known in the art.

A typical multicolor photographic element comprises a support bearing a cyan dye image-forming unit comprising at least one red-sensitive silver halide emulsion layer having associated therewith at least one cyan dye-forming coupler; a magenta image-forming unit comprising at least one green-sensitive silver halide emulsion layer having associated therewith at least one magenta dye-forming coupler; and a yellow dye image-forming unit comprising at least one blue-sensitive silver halide emulsion layer having associated therewith at least one yellow dye-forming coupler. The element may contain additional layers, such as filter layers, interlayers, overcoat layers, subbing layers, and the like.

The photographic elements may also contain a transparent magnetic recording layer such as a layer containing magnetic particles on the underside of a transparent support, as in U.S. Pat. Nos. 4,279,945 and 4,302,523. Typically, the element will have a total thickness (excluding the support) of from about 5 to about 30 microns.

In the following discussion of suitable materials for use in the elements of this invention, reference will be made to *Research Disclosure*, December 1978, Item 17643, and *Research Disclosure*, December 1989, Item No. 308119, both published by Kenneth Mason Publications, Ltd., Dudley Annex, 12a North Street, Emsworth, Hampshire PO10 7DQ, ENGLAND, the disclosures of which are incorporated herein by reference.

These publications will be identified hereafter by the term "Research Disclosure." A reference to a particular section in "Research Disclosure" corresponds to the appropriate section in each of the above-identified *Research Disclosures*. The elements of the invention can comprise emulsions and addenda described in these publications and publications referenced in these publications.

As noted above, the silver halide emulsions employed in the elements of this invention can also include other silver halide grains. Such grains can be comprised of silver bromide, silver chloride, silver iodide, silver bromochloride, silver iodochloride, silver iodobromide, silver iodobromochloride or mixtures thereof. The emulsions can include silver halide grains of any conventional shape or size. Specifically, the emulsions can include coarse, medium or fine silver halide grains. High aspect ratio tabular grain emulsions are specifically contemplated, such as those disclosed by Wilgus et al. U.S. Pat. No. 4,434,226, Daubendiek et al. U.S. Pat. No. 4,414,310, Wey U.S. Pat. No. 4,399,215, Solberg et al. U.S. Pat. No. 4,433,048, Mignot U.S. Pat. No. 4,386,156, Evans et al. U.S. Pat. No. 4,504,570, Maskasky U.S. Pat. No. 4,400,463, Wey et al. U.S. Pat. No. 4,414,306, Maskasky U.S. Pat. Nos. 4,435,501 and 4,643,966 and Daubendiek et al. U.S. Pat. Nos. 4,672,027 and 4,693,964, all of which are incorporated herein by reference. Also specifically contemplated are those silver iodobromide grains with a higher molar proportion of iodide in the core of the grain than in the periphery of the grain, such as those described in British Reference No. 1,027,146; Japanese Reference No. 54/48,521; U.S. Pat. Nos. 4,379,837; 4,444,877; 4,665,012; 4,686,178; 4,565,778; 4,728,602; 4,668,614 and 4,636,461; and in European Reference No 264,954, all of which are incorporated herein by reference.

The silver halide emulsions can be either monodisperse or polydisperse as precipitated. The grain size distribution of the emulsions can be controlled by silver halide grain separation techniques or by blending silver halide emulsions of differing grain sizes.

Dopants, such as compounds of copper, thallium, lead, bismuth, cadmium and Group VIII noble metals, can be present during precipitation of any of the grains of the silver halide emulsion. Other dopants include transition metal complexes as described in U.S. Pat. Nos. 4,981,781, 4,937,180, and 4,933,272.

The emulsions can be surface-sensitive emulsions, i.e., emulsions that form latent images primarily on the surface of the silver halide grains; or internal latent image-forming emulsions, i.e., emulsions that form latent images predominantly in the interior of the silver halide grains. The emulsions can be negative-working emulsions such as surface-sensitive emulsions or unfogged internal latent image-forming emulsions, but can also be direct-positive emulsions of the unfogged, internal latent image-forming type, which are positive-working when development is conducted with uniform light exposure or in the presence of a nucleating agent.

The silver halide emulsions can further be surface-sensitized, and noble metal (e.g., gold), middle chalcogen (e.g., sulfur, selenium, or tellurium) and reduction sensitizers, employed individually or in combination, are specifically contemplated. Typical chemical sensitizers are listed in *Research Disclosure*, Item 308119, cited above, Section III.

The silver halide emulsions can be spectrally sensitized with dyes from a variety of classes, including the polymethine dye class, which includes the cyanines, merocyanines, complex cyanines and merocyanines (i.e., tri-tetra-, and polynuclear cyanines and merocyanines), oxonols, hemioxonols, stryryls, merostyryls, and streptocyanines. Illustrative spectral sensitizing dyes are disclosed in *Research Disclosure*, Item 308119, cited above, Section IV.

Suitable vehicles for the emulsion layer and other layers of elements of this invention are described in *Research Disclosure*, Item 308119, Section IX and the publications cited therein.

The elements of this invention can include couplers as described in *Research Disclosure*, Section VII, paragraphs D, E, F, and G and the publications cited therein. The couplers can be incorporated/as described in *Research Disclosure*, Section VII, paragraph C, and the publications cited therein. Also contemplated are elements which further include image modifying couplers as described in *Research Disclosure*, Item 308119, Section VII, paragraph F.

The photographic elements of this invention can contain brighteners (*Research Disclosure*, Section V), antifoggants and stabilizers such as mercaptoazoles (for example, 1-(3-ureidophenyl)-5-mercaptotetrazole), azolium salts (for example, 3-methylbenzothiazolium tetrafluoroborate), thiosulfonate salts (for example, p-toluene thiosulfonate potassium salt), tetraazaindenes (for example, 4-hydroxy-6-methyl-1,3,3a,7-tetraazaindene), and those described in *Research Disclosure*, Section VI, antistain agents and image dye stabilizers (*Research Disclosure*, Section VII, paragraphs I and J), light absorbing and scattering materials (*Research Disclosure*, Section VIII), hardeners (*Research Disclosure*, Section X), polyalkyleneoxide and other surfactants as described in U.S. Pat. No. 5,236,817, coating aids (*Research Disclosure*, Section XI), plasticizers and lubricants (*Research Disclosure*, Section XII), antistatic agents (*Research Disclosure*, Section XIII), matting agents (*Research Disclosure*, Section XII and XVI) and development modifiers (*Research Disclosure*, Section XXI.

The photographic elements can be coated on a variety of supports as described in *Research Disclosure*, Section XVII and the references described therein.

The photographic elements of the invention can be exposed with various forms of energy which encompass the ultraviolet, visible, and infrared regions of the electromagnetic spectrum as well as with electron beam, beta radiation, gamma radiation, x-ray, alpha particle, neutron radiation, and other forms of corpuscular and wave-like radiant energy in either noncoherent (random phase) forms or coherent (in phase) forms, as produced by lasers. When the photographic elements are intended to be exposed by x-rays, they can include features found in conventional radiographic elements, such as those disclosed in *Research Disclosure*, Vol. 184, August 1979, Item 18431 which is incorporated herein by reference.

The photographic elements of the invention are preferably exposed to actinic radiation, typically in the visible region of the spectrum, to form a latent image as described in *Research Disclosure*, Section XVIII, and then processed to form a visible dye image as described in *Research Disclosure*, Section XIX. Processing to form a visible dye image includes the step of contacting the element with a color developing agent to reduce developable silver halide and oxidize the color developing agent. Oxidized color developing agent in turn reacts with the coupler to yield a dye.

Preferred color developing agents are p-phenylenediamines. Especially preferred are 4-amino-3-methyl-N,N-diethylaniline hydrochloride, 4-amino-3-methyl-N-ethyl-N-(β-methanesulfonamidoethyl)-aniline sulfate hydrate, 4-amino-3-methyl-N-ethyl-N-(β-hydroxyethyl)-aniline sulfate, 4-amino-3-(β-methanesulfonamidoethyl)-N,N-diethylaniline hydrochloride, and 4-amino-N-ethyl-N-(β-methoxyethyl)-m-toluidine di-p-toluenesulfonic acid.

With negative-working silver halide emulsions, the processing step described above provides a negative image. The described elements can be processed in the known C-41 color process as described in, for example, the British Journal of Photography Annual, 1988, pages 196–198. To provide a positive (or reversal) image, the color development step can be preceded by development with a non-chromogenic developing agent to develop exposed silver halide, but not form dye, and then uniformly fogging the element to render unexposed silver halide developable. Reversal processing of the element of the invention is preferably done in accordance with the known E6 process as described and referenced in *Research Disclosure* paragraph XIX. Alternatively, a direct positive emulsion can be employed to obtain a positive image.

Development is followed by the conventional steps of bleaching, fixing, or bleach-fixing, to remove silver or silver halide, washing, and drying.

The methods of making the novel grains utilized in the present invention generally comprise the following steps: providing a dispersing medium and preformed {100} silver halide tabular grains in a reaction vessel; adsorbing to the surfaces of the preformed grains a silver halide {111} or {110} growth modifier; and precipitating or Ostwald ripening a sufficient amount of additional silver halide onto the surfaces of the preformed grains in the presence of the silver halide {111} or {110} growth modifier so as to form the substantially equivalent {111} or {110} corner or side faces. Where the preformed tabular grains are {100} predominantly silver bromide tabular grains, it is contemplated that adjusting excess bromide ion concentrations will allow one to obtain the {111} crystal faces in the absence of growth modifier.

In preparing emulsions in accordance with the above procedures, it is contemplated that precipitation or ripening occur by any method known in the art, for instance, single or double jet precipitation, and that it occurs in the form of lateral growth (relative to the plane of the preformed {100} silver halide tabular grains) until the corner or side faces are formed. Growth may also occur non-laterally. In such instances, growth will result in corner or side faces that extend, i.e. protrude, above the plane of the preformed {100} silver halide tabular grains. Optionally, continued growth via precipitation or ripening may occur to thicken the grain, thus eliminating the appearance of protrusions. In these instances, though the grains are thickened, they retain their {111} or {110} corner or side faces.

In preparing emulsions in accordance with the present invention, it is also contemplated that the corner or side faces, although {111} or {110} faces, be allowed to round slightly (e.g. by excess ripening or precipitation) or become slightly concave. These corner or side faces would then actually have multiple sub-faces within each corner or side face, the sub-faces being the same or different from that of the corner or side faces. In all instances, however, the plane of the corner or side faces is consistent with the Miller index designation of that face.

In making the grains, the preformed {100} tabular grains are predominantly silver chloride or silver bromide; and it is preferred that the growth modifiers be those that cause the formation of the {111} or {110} faces on the predominantly silver chloride or silver bromide {100} tabular grains, and that the additionally precipitated or ripened silver halide be predominantly silver chloride or silver bromide. It is desired that the tabular grains be of similar halide composition as that of the additional precipitate, and it follows that the growth modifier be such as to allow the precipitation or ripening to occur. In other words, if the desired grains are to be predominantly silver chloride grains having eight {111} corner faces, the growth modifier should be a silver chloride {111} growth modifier and the additional silver halide should be predominantly silver chloride. Conversely, if the desired grains are to be predominantly silver bromide grains having twelve {110} corner and side faces, the growth modifier should be a silver bromide {110} growth modifier and the additional silver halide should be predominantly silver bromide.

Growth modifiers as used herein and as typically referred to in the art are those compounds that allow for the formation of specific types of crystal faces. Growth modifiers effect the specific manner in which additional silver halide is precipitated or ripened onto a seed grain. In essence, they adsorb to a particular type of crystal face and prevent the continued growth of that type of crystal face while allowing for the continued growth of other types of crystal faces.

The amount of growth modifier required to control growth of the grain population is a function of the total grain surface. Thus, the benefits of the invention can be realized using any amount of growth modifier that is effective to retard growth of {111} or {0} faces of the preformed tabular grains.

It is generally contemplated to have present in the emulsion during growth sufficient growth modifier to provide a monomolecular adsorbed layer over at least 25 percent, preferably at least 50 percent, of the total grain surface area of the emulsion grains. Higher amounts of adsorbed growth modifier are, of course, feasible. Adsorbed growth modifier coverages of 80 percent of the monomolecular layer coverage or even 100 percent coverage are contemplated. Excess growth modifier is also contemplated as any growth modifier that remains unadsorbed is normally depleted in post-precipitation emulsion washing.

The growth modifiers can be added initially to the preformed tabular emulsion grains at the start of precipitation or can be incrementally added as the surface area of the emulsion increases. They are preferably adsorbed to the surfaces of the preformed grains under reaction conditions in which pH, pAg, temperature range from 1.5° to 8.0°, 5.0° to 10.0°, and 15° to 95° C., respectively. In the preferred processes of the invention, pH ranges from 3.5 to 7.0, pAg ranges from 6.0 to 9.5, and temperature ranges from 35° to 80° C. It is contemplated that pH can be higher than 8.0 if the invention were practiced in the presence of ammonia.

Grain growth modifiers suitable for the present invention are those known in the art to be strong growth modifiers. Examples of silver chloride {111} growth modifiers suitable for use in the present invention include those selected from the group consisting of a 4,6-di(hydroamino)-5-aminopyrimidine compound, 4-aminopyrazolo[3,4-d]pyrimidine, a xanthine or 8-azaxanthine compound, 6-hydroaminopurine, and a 7-azaindole. Other examples can be found in U.S. Pat. Nos. 5,183,732, 5,176,992, 5,217,858, 5,185,239, and 5,178,997, all of which are incorporated herein by reference.

Examples of silver bromide {111} growth modifiers suitable for use in this invention are disclosed in copending U.S. patent application Ser. No. 195,807 filed Feb. 14, 1994, the disclosure of which is incorporated herein by reference.

Examples of silver bromide {110} growth modifiers suitable for use in the present invention include those selected from the group consisting 2-mercaptopyridine, 1-phenyl-5-mercaptotetrazole, 5-imino-3-thiourazole, 2-mercapto-1,3-benzoxazole, and 2-mercapto-1-phenylbenzimidazole. Other examples can be found in Maskasky, "The Seven Different Kinds of Crystal Forms of Photographic Silver Halides" Journal of Imaging Science, Vol. 30, 1986, pp. 247–255; Maskasky, "A comparison of Some Properties of AgBr Rhombic Dodecahedra with and without Adsorbed Growth Modifier", The Society for Imaging Science and Technology, Vol. 32, 1988, pp 95–99; and U.S. Pat. No. 3,817,756, all of which are incorporated herein by reference.

To prepare the preferred grains employed in the invention, square or rectangular predominantly silver chloride {100} tabular grains formed by methods known in the art, for instance those methods described in U.S. Pat. Nos. 5,264,337, 5,275,930, and 5,292,632, and published European Patent Application 0 534 395, are precipitated or ripened upon by additional silver chloride in the presence of a silver chloride {111} growth modifier. The resulting silver chloride grains comprise an essentially tabular base portion having eight substantially equivalent corner faces that are of the {111} type. Preferred parameters for the construction of such grains are as described above with reference to the adsorbtion of growth modifier onto the preformed tabular grains. In addition, it is desired that the dispersing medium comprise gelatin and that gelatin levels be between 0.1 percent and 10 percent by weight. The specifically preferred grain growth modifiers are 4,5,6 triaminopyrimidine and 4-aminopyrazolo[3,4-d]pyrimidine.

The invention can be better appreciated by reference to the following specific examples. They are intended to be illustrative and not exhaustive of the elements of the present invention and the methods of formation of grains employed in such elements.

EXAMPLES

Figure 2:
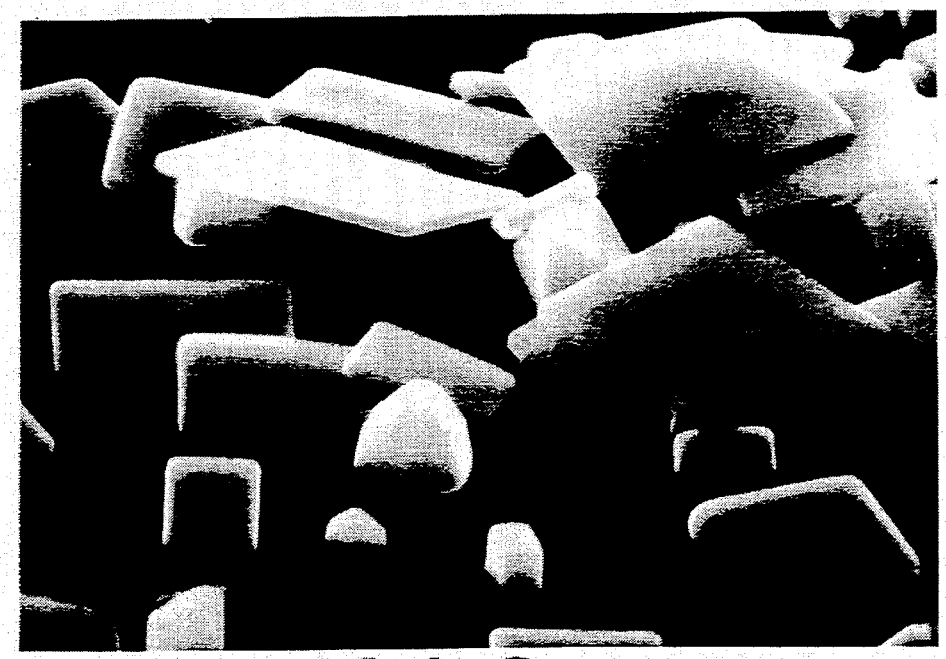
FIG. 2 is a scanning electron micrograph (×10,000) of a predominantly silver chloride {100} tabular grain emulsion, Host Emulsion A.

A Host Emulsion A was prepared in accordance with the procedures delineated in European Patent Application 0 534 395. The resultant predominantly silver chloride tabular grains had two parallel major {100} crystal faces. Further, they had a mean equivalent circular diameter of 2.5 microns and a thickness of 0.16 microns. Host emulsion A is represented in FIG. 2.

Example 1

To a stirred reaction vessel containing 0.04 mole of Host Emulsion A in 400 mL of a solution at pH 6.1 and at 60° C. that was 2 percent in bone gelatin, 2.0 mM 4,5,6-triaminopyrimidine, 0.040M NaCl and 0.20M sodium acetate were added 7.0 mL of 4M $AgNO_3$ at 1.0 mL/min and 4.5M NaCl solution at a rate needed to maintain a constant pCl of 1.42. The pH was maintained at 6.1. The resulting emulsion was examined by scanning electron microscopy (FIG. 1). It consisted of silver chloride grains having two faces at each of their corners. Examination of the grain corners at appropriate angle revealed an angle between the two corner faces to be 110°, thus confirming that they were {111} faces.

With particular reference to FIG. 1, one notes the eight substantially equivalent {111} corner faces on the seed {100} tabular grain. These {111} corner faces can continue to be grown until the resulting grain approximates an octahedron. Complete octahedrons are outside of the scope of this invention as such would encapsulate voids. However, as long as encapsulation of multiple voids does not occur, the {111} corner faces can continue to be grown.

Example 2

Figure 3:
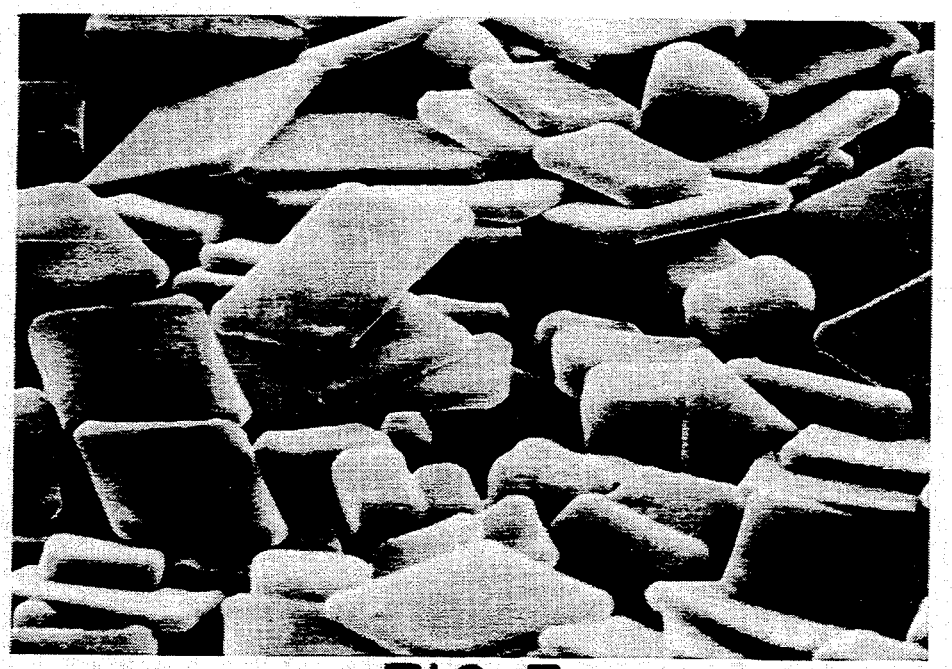
FIG. 3 is a scanning electron micrograph (×10,000) of the grains employed in a preferred embodiment of the invention, Example 2.

The emulsion of this example was prepared similar to that of Example 1 except that 3.0 mL of the 4M $AgNO_3$ solution was added requiring 3 min. The resulting emulsion was examined by scanning electron microscopy. It consisted of high chloride tabular grains similar to those of Example 1 except the corner faces were smaller, FIG. 3.

Example 3

Figure 4:
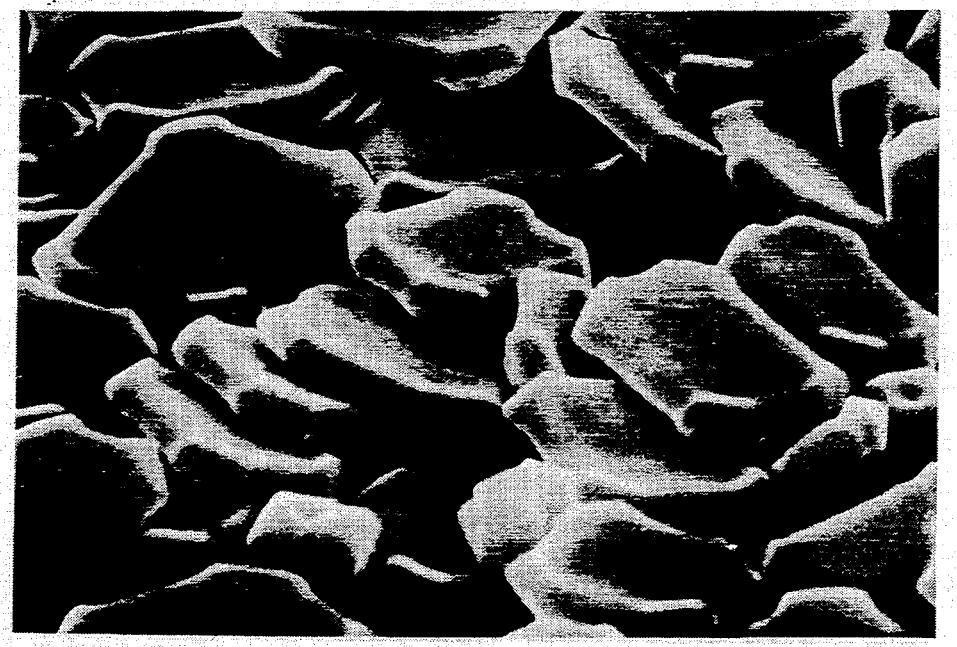
FIG. 4 is a scanning electron micrograph (×10,000) of the grains employed in a preferred embodiment of the invention, Example 3.

The emulsion of this example was prepared similar to that of Example 1 except that 15.0 mL of the 4M $AgNO_3$ solution was added requiring 15 min. The resulting emulsion grains had {111} corner faces larger than those of Example 1. A scanning electron photomicrograph is shown in FIG. 4.

The invention has been described in detail with particular reference to preferred embodiments thereof, but it will be understood that variations and modifications can be effected within the spirit and scope of the invention.

What is claimed is:

1. A photographic element comprising a support and a silver halide emulsion layer, the silver halide emulsion layer having incorporated therein silver halide grains, wherein the grains are essentially tabular in morphology and have two parallel {100} major faces, and {111} corner faces or {110} corner faces or {110} side faces, and wherein the corner or side faces are formed by non-epitaxial deposits of silver halide that protrude from the {100} major faces.

2. A photographic element according to claim 1 wherein the grains comprise eight {111} corner faces, or four {110} corner faces and eight {110} side faces.

3. A photographic element according to claim 2 wherein said grains are predominantly silver chloride.

4. A photographic element according to claim 2 wherein said grains are predominantly silver bromide.

5. A photographic element according to claim 2 wherein the grains have an aspect ratio greater than about two.

6. A photographic element according to claim 5 the grains have an grains have an aspect ratio greater than about five.

7. A photographic element according to claim 6 wherein the grains have an aspect ratio greater than about eight.

8. A photographic element comprising a support and a silver halide emulsion layer, the silver halide emulsion layer having incorporated therein silver halide grains wherein the grains comprise a base portion of silver halide having two parallel {100} major faces and, protruding from the {100} major faces, additional non-epitaxial silver halide that forms at least eight {111} or at least eight {110} faces, the {111} faces, when present, protruding from the corners of the {100} major faces and the {110} faces, when present, protruding from the sides of the major faces.

* * * * *